US005743650A

United States Patent [19]

Shannon et al.

[11] Patent Number: 5,743,650

[45] Date of Patent: Apr. 28, 1998

[54] COLLECTION BAG SUSPENSION

[76] Inventors: Sandra G. Shannon, 702 Bishop, Clifton, Tex. 76634; Janie L. Hulme, Rte. 1, Box 73A, Clifton, Tex. 76634

[21] Appl. No.: 752,245

[22] Filed: Nov. 19, 1996

[51] Int. Cl.[6] ..... B65D 30/22

[52] U.S. Cl. ..... 383/16; 224/407; 224/572; 280/304.1; 383/24; 383/40; 604/322; 604/326

[58] Field of Search ..... 383/16, 22, 23, 383/24, 38, 40; 604/326, 322; 280/304.1; 224/407, 563, 572

[56] References Cited

U.S. PATENT DOCUMENTS

| | | | |
|---|---|---|---|
| 2,761,481 | 9/1956 | Boatwright | 383/22 |
| 2,886,036 | 5/1959 | Price | 604/326 |
| 3,568,965 | 3/1971 | Clark | 383/22 |
| 3,865,165 | 2/1975 | Glass | 383/24 |
| 4,240,480 | 12/1980 | Strobel | 383/15 |
| 4,606,736 | 8/1986 | Van De Weghe | 604/322 |
| 4,718,689 | 1/1988 | Lott | 604/326 |
| 4,874,387 | 10/1989 | Boone | 604/326 |
| 4,888,005 | 12/1989 | Dingeman | 280/304.1 |
| 5,326,175 | 7/1994 | Carter | 383/22 |

FOREIGN PATENT DOCUMENTS

| | | | |
|---|---|---|---|
| 668355 | 12/1988 | Switzerland | 383/22 |

*Primary Examiner*—Stephen P. Garbe
*Attorney, Agent, or Firm*—Jack A. Kanz

[57] ABSTRACT

A collection bag and its associated tubing are supported below the seat of a wheelchair or the like with the collection bag disposed substantially horizontally and below its associated inlet tubing. A separate pocket holds the inlet tubing coiled above the bag so that fluids may drain by gravity through the tubing into the collection bag. The suspension apparatus comprises a main pocket attached to the seat frame of a chair or the like using a plurality of strap and a secondary pocket supporting the tubing coil above the main pocket. The collection bag and tubing are thus substantially concealed from view and the inlet tubing maintained in a coiled position above the collection bag.

15 Claims, 2 Drawing Sheets

COLLECTION BAG SUSPENSION

COLLECTION BAG SUSPENSION

This invention relates to suspension of drainage or collection bags and their associated inlet tubing on a wheelchair, bed or the like. More particularly, it relates to pouch-like apparatus for supporting a drainage bag or the like in a position wherein its largest peripheral dimensions extend substantially horizontal while supporting the inlet tubing in a relatively fixed position above the bag. The suspension system of the invention thus not only provides proper support for the collection bag and its associated inlet tubing, the system aids in concealing unsightly collection bags from view.

BACKGROUND OF THE INVENTION

As a result of surgical intervention or other conditions, many patients are required to employ external apparatus for collecting and temporarily storing bodily fluids. Typically, the collection apparatus employs a Foley catheter or the like which provides an interface between the patient and an external storage system comprising a collection bag and a length of flexible tubing. The collection bag must be suspended below the level of the catheter so that fluids drain by gravity from the patient to the bag. The collection bag is conventionally formed of flexible transparent material and adapted to collect and temporarily store fluids as they drain from the catheter. Such collection systems are commonly supported on hospital beds, stands and the like.

In order to permit patent mobility, drainage and collection systems are often attached to wheelchairs and the like. Most wheelchairs include a seat support frame and/or cross member support positioned below the chair seat which provides convenient means for supporting the collection bag. Unfortunately, collection bags suspended below the chair seat become particularly unsightly as fluids collect therein. More significantly, the inlet tubing which connects the catheter to the bag must be carefully positioned to ensure proper drainage therethrough to the collection bag. If the tubing is blocked, drainage is prevented. If the tubing is allowed to extend below the collection bag, fluid flow is blocked by fluid collected in the lowest portions of the tubing. When properly positioned, the tubing is coiled and placed above the inlet to the bag so that fluid collected in the tubing must eventually drain into the bag. However, fluid may collect in the lower portions of the coils of tubing and thus provide a liquid plug to prevent vapor reflux from the bag.

When collection bags are suspended from the seat frame or support members of a wheelchair or the like in conventional manner, the bag is exposed and not restrained from swaying, etc., as the chair is moved. More importantly, the inlet tubing (unless carefully restrained) tends a sag and contribute to the problems discussed above.

SUMMARY OF THE INVENTION

In accordance with the present invention, a support system is provided which secures a collection bag and its associated tubing to a wheelchair or the like and maintains the bag and tubing oriented to assure proper drainage. As a result of the orientation of the suspension system, the bag and its associated inlet tubing are substantially concealed.

The preferred embodiment of the invention comprises a flexible body made of fabric or the like which defines a main pocket or pouch sized to hold the collection bag and a secondary pocket or pouch sized and positioned to hold the tubing in a coiled condition above the main pocket. A slit in the wall separating the main pocket from the secondary pocket allows the tubing to pass from the main pocket to the secondary pocket without kinking or binding. The apparatus is secured to a wheelchair or the like by securing means such as a plurality of straps extending from the periphery of the body defining the main pocket. The straps toward the rear of the main pocket may be longer than the front straps to support the rear edge (bottom) of the collection bag at a lower elevation than the front edge (top). The straps may be simple ties or may be formed with one end sewn into a lateral edge of the body of the suspension apparatus and the other end removeably secured to the strap, the body of the suspension apparatus or the chair by snaps, buttons, hooks, loops or the like. The suspension apparatus thus stores the collection bag in a substantially horizontal position below the seat of the chair and the bag is secured and substantially hidden from view. Other features and advantages of the invention will become more readily understood from the following detailed description taken in connection with the appended claims and attached drawing wherein:

DESCRIPTION OF THE PREFERRED EMBODIMENTS

Figure 1:
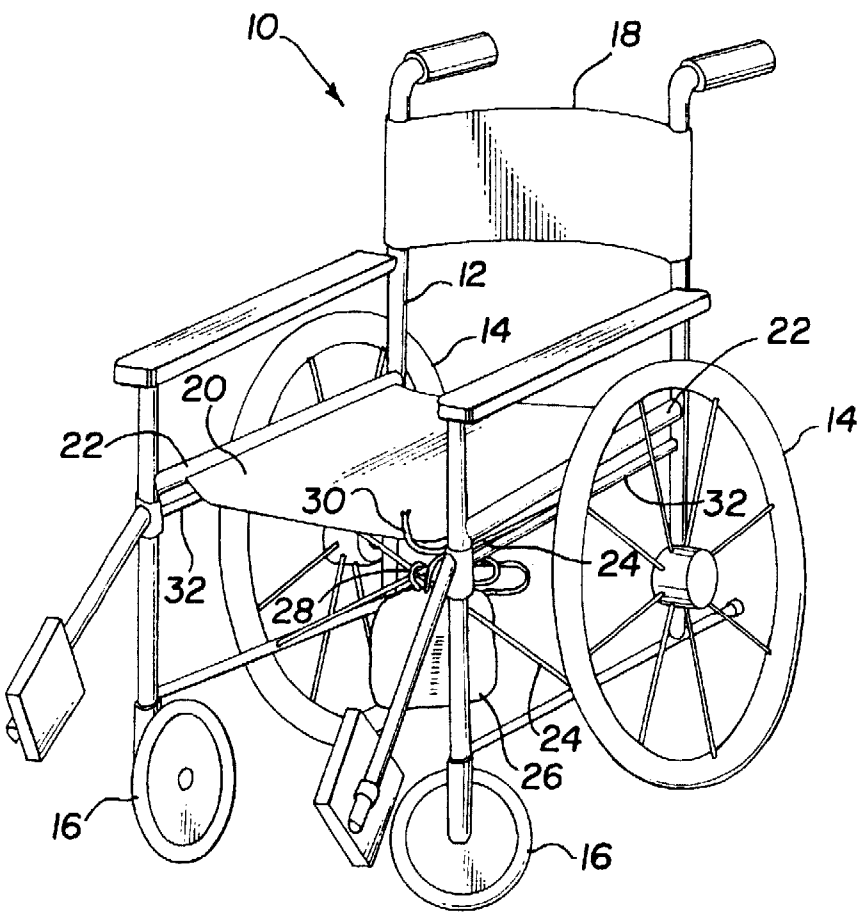
Fig. 1 (PRIOR ART)
FIG. 1 is a perspective view of a collection bag and tubing mounted on a wheelchair in traditional fashion.

A conventional collection bag and its associated tubing are traditionally attached to a wheelchair or the like by suspending the bag below the chair seat as illustrated in FIG. 1. The wheelchair 10 includes frame 12, rear wheels 14, front wheels 16, back 18 and seat 20. Seat 20 is attached to wheelchair 10 by seat support rails 22 of frame 12. Frame 12 also includes cross members 24 which act to stiffen and support frame 12 under the weight of a patient in seat 20 and fold to permit the chair assembly to be collapsed when not in use. Collection bag 26 is attached to cross members 24 with a hook 28 or the like. Ordinarily, tubing 30 extending from a catheter to the inlet of bag 26 is tied to cross members 24 above the bag 26 so that fluid may drain therethrough to the bag 26.

When properly secured as shown in FIG. 1, the collection bag 26 and tubing 30 perform adequately. However, the system shown in FIG. 1 often results in tubing 30 uncoiling or sagging so that part of the tubing 30 extends to or below the level of collection bag 26, preventing proper drainage from the catheter and increasing the risk of infection. Further, collection bag 26 may become dislodged when wheelchair 10 bumps is jarred or when hook 30 is otherwise dislodged from cross members 24. The results of such occurrences are obviously undesireable. Furthermore, the entire bag 26 is exposed and in plain view.

Figure 2:
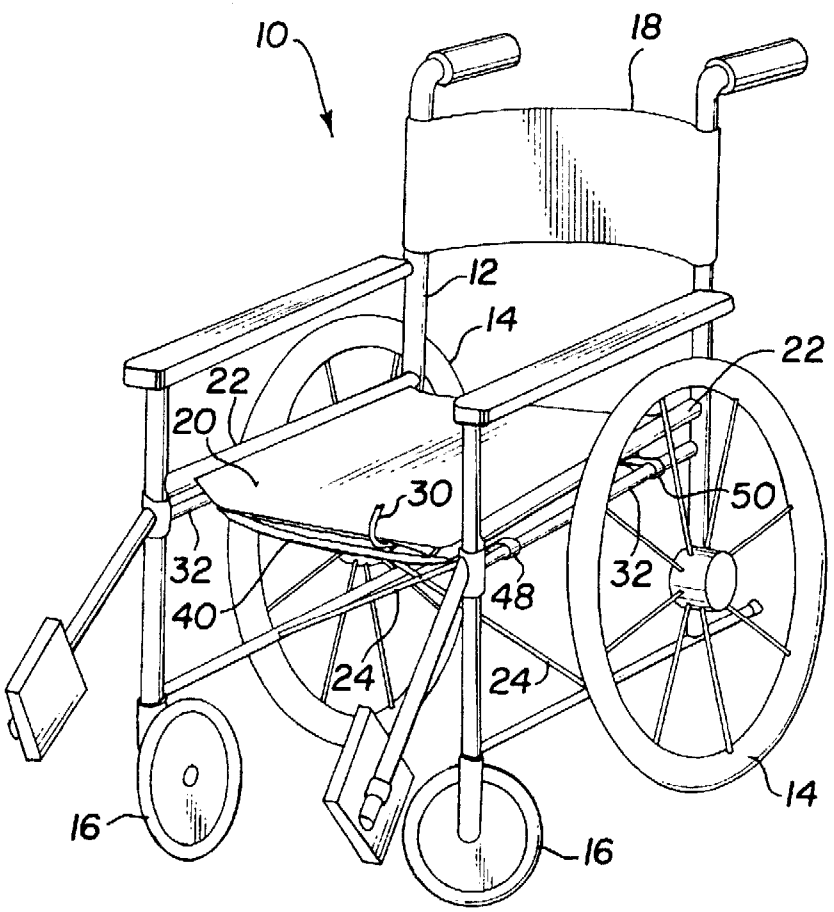
FIG. 2 is a perspective view of a collection bag and tubing mounted on a wheelchair in accordance with the present invention.

A wheelchair 10 incorporating a preferred embodiment of the present invention is illustrated in FIG. 2. Wheelchair 10 includes frame 12, rear wheels 14, front wheels 16, back 18 and seat 20 joined and supported by cross members 24 as described above. However, instead of hanging the collection bag from the cross members 24 of frame 12 as in FIG. 1 the collection bag and associated tubing 30 are contained with suspension apparatus 40 as best shown in FIGS. 3 and 4 and supported as shown in FIG. 2.

Collection bag suspension apparatus 40 is designed to support the collection bag 26 so that the largest peripheral dimensions of the bag 26 are aligned substantially horizontal. The collection bag 26 is ordinarily a pouch formed by two sides attached to each other along their peripheral edges. The side edges are conventionally about ten (10) inches by ten (10) inches forming a bag which is substantially square in outer peripheral dimensions. Such bags are usually suspended by a suspension clamp or the like which attaches to one corner of the bag so that the bag hangs in the form of a ten inch square diamond. In accordance with the invention, the square bag is supported horizontally so that the elevational (side edge) view is only the thickness of the bag rather than the length of the bag.

Figure 3:
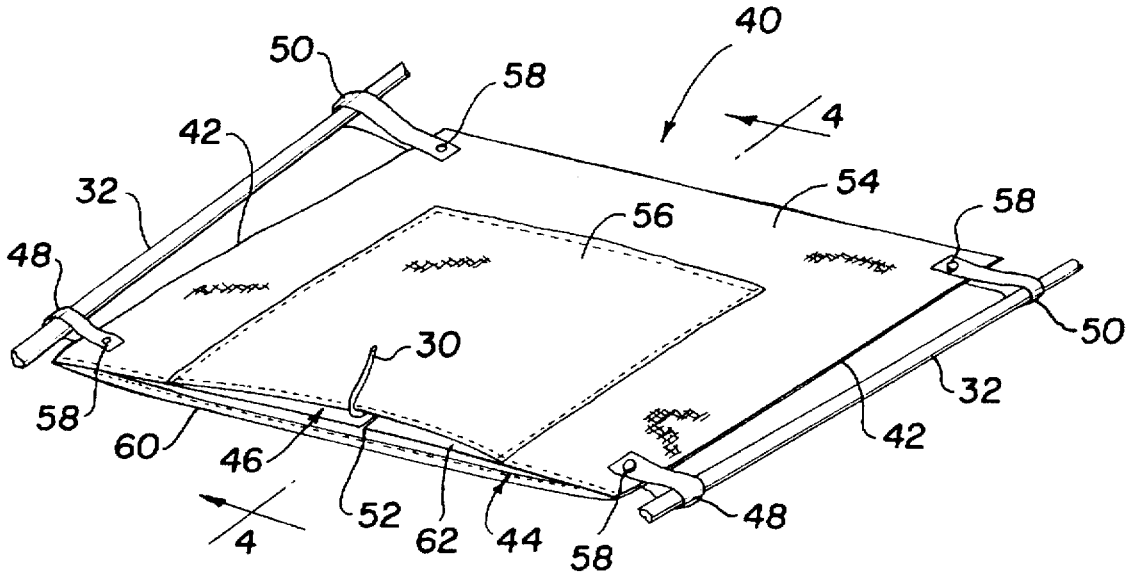
FIG. 3 is a perspective view of a preferred embodiment of the suspension system of the present invention.
Figure 4:
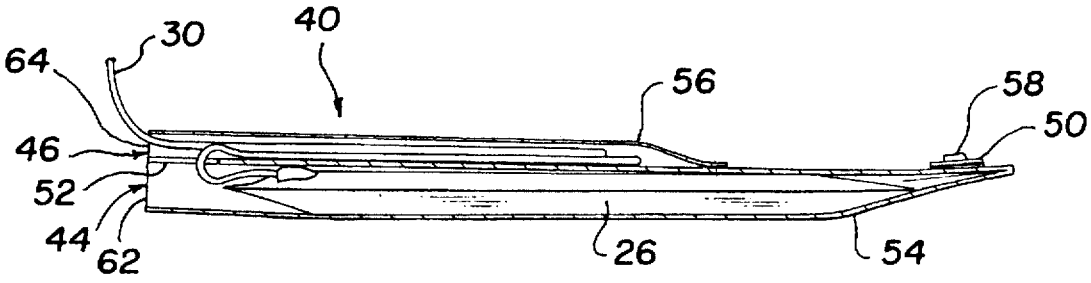
FIG. 4 is a sectional view of the embodiment of FIG. 3. Like numerals are used to refer to like parts throughout the several views of the drawing.

As illustrated in FIG. 3 the preferred embodiment of suspension apparatus 40 comprises a body which defines a main pocket or pouch 44 and a secondary pocket or pouch 46. Main pocket 44 is readily formed by folding a suitably sized sheet of fabric or other flexible sheet material in half and sewing or otherwise attaching lateral edges 42 to each other. This procedure forms main pocket 46 with a front opening 60. Main pocket 44 is sized and shaped to hold the collection bag 24. A secondary pocket 46, designed to hold excess tubing 30, is formed on the upper external face of main pocket 44. Secondary pocket 46 is preferably formed by a second section of sheet material 56 sewn or otherwise attached to first section of material 54. Secondary pocket 46 is disposed on the top side of main pocket 44 so that tubing 30 properly coiled therein is above the collection bag to allow proper drainage. A slit 52 in first section 54 between main pocket 44 and secondary pocket 46 allows tubing 30 to extend from the collection bag in main pocket 44 to the secondary pocket 46 without kinking or binding and without exposing the top end of the bag 26.

Apparatus 40 is preferably suspended below seat 20 of wheelchair 10 by front straps 48 and rear straps 50. Front and rear straps 48, 50 may be attached to any suitable portion of frame 12 but are particularly suited for mounting to seat support rails 22 which hold seat 20 or, alternatively, to lateral support rails 32 which are under seat support rails 22 on wheelchair 10 as shown in FIG. 2. Inlet tubing 30, extending from the collection catheter (not shown) or similar device, is coiled above the horizontally disposed collection bag 26.

Collection bag suspension apparatus 40 may be secured to lateral support rails 32 or other suitable portion of the wheelchair using front straps 48 and rear straps 50. In the preferred embodiment, one end of each strap is sewn or otherwise secured to a lateral edge 42 of the material forming main pocket 44 and the other end is removeably attached thereto by securing mechanism 58 which can be snaps, buttons, ties, hook and loop fabric such as Velcro™ or the like. The securing mechanism (as well as the straps 48, 50) may be any common mechanism such as strap made of fabric, plastic or metal and may include hooks, adhesives, snaps, buttons, etc. The straps, of course, may also be elastic if desired. Rear straps 50 are preferably longer than front straps 48 so that the rear edge of the suspension apparatus 40 is lower than the front. This aids in proper positioning of the collection bag in relation to tubing 30 and the catheter and improves drainage of fluids from the catheter.

As illustrated in FIGS. 3 and 4 the suspension apparatus comprises a fabric body which defines a main pocket 44. Bag 26 is disposed in main pocket 44. A second section of fabric 56 is attached to the upper side of the body defining main pocket 44 to form secondary pocket 46. Secondary pocket 46 holds the excess tubing 30 which extends from collection bag 26 through tubing slit 52. Tubing 30 exits secondary pocket 46 and extends to the catheter (not shown) or similar device.

In the preferred embodiment, main pocket 44 is about seventeen (17) inches square and slit 52 is about three (3) inches long. Secondary pocket 46 is about twelve (12) inches square. Front straps 48 are approximately three and one-half (3½) inches long while rear straps 50 are about six and one-half (6½) inches long. Using ties instead of straps 48 and 50 would increase the length to approximately ten (10) inches.

Apparatus 40 may be formed from any suitable flexible or rigid sheet material such as plastic film, net material or fabric. The pockets or pouches may be formed by sewing, gluing or otherwise bonding the edges of the sheet material together.

It should be understood that the material from which the apparatus 40 is formed may vary as desired. Likewise, the support straps may be formed as part of the body or be removeably secured thereto by buttons, snaps, loops and ties, etc. Likewise, apparatus 40 is not limited for use with a wheelchair but may be used to support a collection bag on any support media such as a chair, stand, bed or other support means. In order to tilt bag 26 so that the bottom of the bag is below its inlet, the securing straps or the like may be adapted to form loops of variable and adjustable length so that the lower end of the bag is supported by the longer loops. While four straps are illustrated, it will be apparent that any number of straps may be used which will support the bag in the desired position. Four straps positioned at substantially equally spaced distances (preferably at or near the corners of the body of the support apparatus) around the periphery of the main pocket have proven satisfactory.

While the invention has been shown and described with particular reference to urinary drainage bags using Foley catheters and suspension from wheelchairs, the invention is not so limited. The invention is intended for use in any system employing a collection bag and associated inlet tubing. It is to be understood, therefore, that although the invention has been described with particular reference to specific embodiments thereof, the forms of the invention shown and described in detail are to be taken as preferred embodiments of same. Various changes and modifications may be resorted to without departing from the spirit and scope of the invention as defined by the appended claims.

What is claimed:

1. Apparatus for supporting a collection bag and its associated inlet tubing in a substantially horizontal position comprising a body which defines:

a) a main pocket sized to hold a collection bag with its largest dimension disposed substantially horizontal;

b) a secondary pocket adapted to hold inlet tubing associated with said collection bag and to maintain said tubing above the body of a collection bag positioned in said main pocket;

c) a divider defined by the main pocket and the secondary pocket which includes a slit to allow the inlet tubing to pass between the secondary pocket and the main pocket; and d) means for attaching the body which defines said main pocket to a support medium and maintaining said main pocket in a position so that the largest dimension of a drainage bag confined therein is disposed substantially horizontal.

2. Apparatus as defined in claim 1 wherein said means for attaching comprises straps attached at substantially evenly spaced distances around the periphery of said body.

3. The combination comprising:

a) a support medium defining a support frame;

b) a collection bag with associated inlet tubing attached thereto; and c) apparatus supporting said collection bag in a substantially horizontal position below said support frame comprising a body which defines:

i) a main pocket holding said collection bag with its largest dimension disposed substantially horizontal;

ii) a secondary pocket holding the inlet tubing associated with said collection bag disposed above said main pocket so that tubing confined within said secondary pocket is maintained above the body of said collection bag; and iii) means for attaching said body to said support frame and maintaining said main pocket in a position so that the largest dimension of said collection bag confined therein is disposed substantially horizontal.

4. The combination defined in claim 3 wherein said means for attaching comprises straps attached at approximately equally spaced distances around the periphery of said body and secured to said support frame.

5. Apparatus as defined in claim 3 wherein the main pocket and the secondary pocket define a divider which includes a slit allowing the inlet tubing to pass between the secondary pocket and the main pocket.

6. Apparatus for holding a collection bag which is attached via tubing to a catheter comprising:

a) a first section of sheet material folded and secured together along its lateral edges to form a main pocket which defines a top face and a front opening;

b) a second section of sheet material attached to the top face of said main pocket forming a secondary pocket;

c) a slit in the first section of material between the main pocket and the secondary pocket; and d) a plurality of attachment means for securing the apparatus to a support medium, the plurality of attachment means attached to said first section of sheet material.

7. Apparatus as defined in claim 6 wherein said plurality of attachment means comprises two forward straps adjacent said front opening and two rear straps adjacent an edge of the main pocket opposite the front opening.

8. Apparatus as defined in claim 6 wherein said plurality of attachment means comprises straps, each housing a first end sewn into a lateral edge of the main pocket and a second end secured to said main pocket using a snap.

9. Apparatus as defined in claim 6 wherein said plurality of attachment means comprises straps secured to said first section of sheet material which define loops of adjustable length.

10. Apparently as defined in claim 7 wherein said rear straps are longer than said forward straps.

11. A method of securing a collection bag and its associated tubing to a support medium comprising the steps of:

a) forming a first pocket sized to hold a collection bag;

b) forming a second pocket attached to and disposed above said first pocket for holding tubing associated with the collection bag above the collection bag and in a coiled relationship; and c) securing said first pocket to a support medium in a position wherein the longest peripheral dimension of said collection bag is disposed substantially horizontal.

12. A method as defined in claim 11 further comprising the step of forming a slit in the first pocket which allows tubing to pass from the first pocket to the second pocket.

13. A method as defined in claim 11 wherein said first pocket is secured to said support medium with two front straps and two rear straps and including the step of adjusting said rear straps to support the rear edge of said pocket lower than the front edge.

14. A method as defined in claim 11 wherein the step of forming a first pocket comprises folding a first section of sheet material and securing together the lateral edges of the first section of sheet material.

15. A method as defined in claim 14 wherein the step of forming a second pocket attached to the main pocket comprises attaching a second section of sheet material to the top face of the first pocket formed by the first section of sheet material.

* * * * *